US011506025B2

(12) United States Patent
Hepburn et al.

(10) Patent No.: US 11,506,025 B2
(45) **Date of Patent: *Nov. 22, 2022**

(54) MULTILATERAL JUNCTION WITH WELLBORE ISOLATION USING DEGRADABLE ISOLATION COMPONENTS

(71) Applicant: Halliburton Energy Services, Inc., Houston, TX (US)

(72) Inventors: Neil Hepburn, Stamford Bridge (GB); Stuart Alexander Telfer, Stonehaven (GB); Ben Luke Butler, Houston, TX (US); David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/870,231

(22) Filed: May 8, 2020

(65) Prior Publication Data

US 2020/0270970 A1 Aug. 27, 2020

Related U.S. Application Data

(63) Continuation of application No. 15/034,472, filed as application No. PCT/US2014/072504 on Dec. 29, 2014, now Pat. No. 10,655,433.

(51) Int. Cl.
*E21B 41/00* (2006.01)
*E21B 23/12* (2006.01)
(Continued)

(52) U.S. Cl.
CPC ..... *E21B 41/0042* (2013.01); *E21B 23/12* (2020.05); *E21B 29/02* (2013.01);
(Continued)

(58) Field of Classification Search
CPC ..... E21B 41/0042; E21B 23/12; E21B 29/02; E21B 33/13; E21B 41/0035; E21B 43/14
See application file for complete search history.

(56) References Cited

U.S. PATENT DOCUMENTS 4,807,704 A 2/1989 Hsu et al.
5,311,936 A 5/1994 McNair et al.
(Continued)

FOREIGN PATENT DOCUMENTS

CA 2233227 C 6/2006
WO 2000-026501 5/2000
(Continued)

OTHER PUBLICATIONS

"Cellulose Nanocrystals Are A Possible 'Green' Wonder Material," downloaded from http://www.redorbit.com/news/science/1113029897/cellulose-nanocrystals-possible-green-wonder-material-1217/; 4 pages, Dec. 17, 2013.
(Continued)

*Primary Examiner* — Yong-Suk (Philip) Ro
(74) *Attorney, Agent, or Firm* — Scott Richardson; Parker Justiss, P.C.

(57) ABSTRACT

A wellbore isolation system is disclosed. The wellbore isolation system includes a junction positioned at an intersection of a first wellbore and a second wellbore, and a deflector disposed in the junction such that a path into the first leg of the junction is obstructed and engaged with the first leg of the junction to form a fluid and pressure tight seal. The junction includes a first leg extending downhole into the first wellbore, and a second leg extending downhole into the second wellbore. The deflector includes a channel extending axially through the deflector, and a degradable plug disposed in the channel and engaged with the channel to prevent fluid flow through the channel.

20 Claims, 6 Drawing Sheets

(51) Int. Cl.
*E21B 29/02* (2006.01)
*E21B 33/13* (2006.01)
*E21B 43/14* (2006.01)

(52) U.S. Cl.
CPC ..... *E21B 33/13* (2013.01); *E21B 41/0035* (2013.01); *E21B 43/14* (2013.01)

(56) References Cited

U.S. PATENT DOCUMENTS

| | | | |
|---|---|---|---|
| 5,318,122 | A | 6/1994 | Murray et al. |
| 5,322,127 | A | 6/1994 | McNair et al. |
| 5,353,876 | A | 10/1994 | Curington et al. |
| 5,388,648 | A | 2/1995 | Jordan |
| 5,427,177 | A | 6/1995 | Jordan et al. |
| 5,488,989 | A | 2/1996 | Leising et al. |
| 5,520,252 | A | 5/1996 | McNair |
| 5,526,880 | A | 6/1996 | Jordan |
| 5,607,017 | A | 3/1997 | Owens et al. |
| 5,715,891 | A | 2/1998 | Graham |
| 5,875,847 | A | 3/1999 | Forsyth |
| 5,944,108 | A | 8/1999 | Baugh |
| 5,992,524 | A | 11/1999 | Graham |
| 6,012,526 | A | 1/2000 | Jennings et al. |
| 6,026,903 | A | 2/2000 | Shy et al. |
| 6,047,774 | A | 4/2000 | Allen |
| 6,053,254 | A | 4/2000 | Gano |
| 6,145,593 | A | 11/2000 | Henning |
| 6,209,644 | B1 | 4/2001 | Brunet |
| 6,241,021 | B1 | 6/2001 | Bowling |
| 6,244,337 | B1 | 6/2001 | Cumming et al. |
| 6,457,525 | B1 | 10/2002 | Scott |
| 6,464,001 | B1 | 10/2002 | Braithwaite et al. |
| 6,494,264 | B2 | 12/2002 | Pringle et al. |
| 6,533,040 | B2 | 3/2003 | Gondouin |
| 6,561,277 | B2 | 5/2003 | Algeroy et al. |
| 6,712,144 | B2 | 3/2004 | Buytaert |
| 6,712,148 | B2 | 3/2004 | Fipke et al. |
| 6,732,802 | B2 | 5/2004 | Smith |
| 6,786,283 | B2 | 9/2004 | Freeman et al. |
| 6,830,106 | B2 | 12/2004 | Cavender |
| 6,848,504 | B2 | 2/2005 | Brunet et al. |
| 6,915,847 | B2 | 7/2005 | Brockman |
| 6,994,165 | B2 | 2/2006 | Roane et al. |
| 7,090,022 | B2 | 8/2006 | Smith et al. |
| 7,131,493 | B2 | 11/2006 | Eoff et al. |
| 7,207,390 | B1 | 4/2007 | Pratt |
| 8,127,856 | B1 | 3/2012 | Nish et al. |
| 8,220,554 | B2 | 7/2012 | Jordan et al. |
| 8,397,819 | B2 | 3/2013 | Tunget |
| 8,485,259 | B2 | 7/2013 | Sponchia et al. |
| 8,490,697 | B2 | 7/2013 | Garcia et al. |
| 8,528,633 | B2 | 9/2013 | Agrawal et al. |
| 8,573,295 | B2 | 11/2013 | Johnson et al. |
| 8,714,874 | B2 | 5/2014 | Tunget |
| 8,727,028 | B2 | 5/2014 | Johnson |
| 9,200,482 | B2 | 12/2015 | Steele |
| 10,196,880 | B2 | 2/2019 | Steele et al. |
| 10,655,433 | B2 * | 5/2020 | Hepburn ..... E21B 41/0042 |
| 2004/0003925 | A1 | 1/2004 | Desai |
| 2005/0269084 | A1 | 12/2005 | Klimack et al. |
| 2007/0181224 | A1 | 8/2007 | Marya et al. |
| 2008/0135249 | A1 | 6/2008 | Fripp et al. |
| 2011/0048743 | A1 | 3/2011 | Stafford et al. |
| 2012/0305266 | A1 | 12/2012 | Steele |
| 2013/0043127 | A1 | 2/2013 | Graham et al. |
| 2013/0186626 | A1 | 7/2013 | Aitken et al. |
| 2014/0102716 | A1 | 4/2014 | Benson et al. |
| 2014/0116728 | A1 | 5/2014 | Zhou |
| 2014/0124214 | A1 | 5/2014 | Mailand et al. |

FOREIGN PATENT DOCUMENTS

| | | |
|---|---|---|
| WO | 2002-048504 | 6/2002 |
| WO | 2011-071691 | 6/2011 |
| WO | 2011-071901 | 6/2011 |
| WO | 2012-166400 | 12/2012 |
| WO | 2013-044300 | 4/2013 |

OTHER PUBLICATIONS

Baker Hughes, FracPoint Ball-activated Multistage Fracturing Systems, downloaded from http://www.bakerhughes.com/products-and-services/completions/well-completions/multistage-hydraulic-fracturing/fracpoint-multistage-fracturing-system; 13 pages, 2012.

Halliburton Brochure, Mirage Disappearing Plug, downloaded from http://www.halliburton.com/public/cps/contents/Books_and_Catalogs/web/CPSCatalog/06_Packers.pdf, p. 6-82; 1 page, 2015.

Halliburton Brochure, Multilateral Solutions, downloaded from http://www.halliburton.com/public/cps/contents/Books_and_Catalogs/web/CPSCatalog/02_Multilateral%20Solutions.pdf, pp. 2-1 to 2-6; 6 pages, 2015.

International Search Report and Written Opinion, Application No. PCT/US2014/072502; 16 pages, dated Sep. 17, 2015.

International Search Report and Written Opinion, Application No. PCT/US2014/072504, 16 pages, dated Sep. 18, 2015.

J. Fraija et al., "New Aspects of Multilateral Well Construction," Oilfield Review, Autumn 2002; 18 pages, 2002.

J. Oberklrcher, "New system reduces multllateral completlon tlme," Dnlllng Contractor, Nov./Dec. 2000; 2 pages.

S. Bosworth et al., "Key Issues in Multilateral Technology," Oilfield Review, Winter 1998; 15 pages.

Schlumberger, ELEMENTAL Degradable Technology, downloaded from http://www.slb.com/services/completions/multistage_stimulation_systems/continuous_pumping_stimulation/elemental.aspx; 2 pages, 2015.

Office Action for Canadian Patent Application No. 2967560, dated Apr. 12, 2018, 3 pages.

Office Action for Saudi Arabian Patent Application No. GC 2015-30417, dated Mar. 25, 2018; 4 pages.

Office Action for Australian Patent Application No. 2014415640 dated May 9, 2018; 3 pages.

Combined Search and Examination Report of Great Britain Patent Application No. GB2016670.8, dated Nov. 12, 2020; 3 pages.

* cited by examiner

MULTILATERAL JUNCTION WITH WELLBORE ISOLATION USING DEGRADABLE ISOLATION COMPONENTS

RELATED APPLICATION

This application is a U.S. Continuation Patent Application of U.S. patent application Ser. No. 15/034,472 filed May 4, 2016, which is a U.S. National Stage Application of International Application No. PCT/US2014/072504 filed Dec. 29, 2014, which designates the United States.

TECHNICAL FIELD

The present disclosure is related to downhole tools for use in a wellbore environment and more particularly to an assembly for isolating portions of a multilateral wellbore.

BACKGROUND OF THE DISCLOSURE

A multilateral well may include multiple wellbores drilled off of a main wellbore for the purpose of exploration or extraction of natural resources such as hydrocarbons or water. Each of the wellbores drilled off the main wellbore may be referred to as a lateral wellbore. Lateral wellbores may be drilled from a main wellbore in order to target multiple zones for purposes of producing hydrocarbons such as oil and gas from subsurface formations. Various downhole tools may be inserted into the main wellbore and/or lateral wellbore to extract the natural resources from the wellbore and/or to maintain the wellbore during production.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

Embodiments of the present disclosure and its advantages may be understood by referring to FIGS. 1 through 6, where like numbers are used to indicate like and corresponding parts.

At various times during production and/or maintenance operations within a multilateral wellbore, a branch of the multilateral wellbore (e.g., the main wellbore or a lateral wellbore) may be temporarily isolated from pressure and/or debris. In accordance with the teachings of this disclosure, an isolation sleeve and/or a deflector that seals to the junction may be used to temporarily prevent the flow of fluid into or out of the isolated wellbore. To position the isolation sleeve, a deflector may be used. The deflector may be positioned within a junction disposed at the intersection of a main wellbore and a lateral wellbore such that the path into the wellbore to be isolated is obstructed. The isolation sleeve may be inserted into the wellbore, and when the isolation sleeve enters the junction, it may contact the deflector and be deflected away from the wellbore to be isolated. The uphole end of the isolation sleeve may be engaged with a liner uphole from the intersection of the main wellbore and the lateral wellbore to form a fluid and pressure tight seal. The downhole end of the isolation sleeve may engage with the main or lateral leg of a junction installed at the intersection of the main wellbore and the lateral wellbore to form a fluid and pressure tight seal. Additionally, the deflector may engage with the junction to form a fluid and pressure tight seal, thereby preventing fluid flow into and out of the isolated wellbore. The seal formed between the deflector and the junction may permit temporary isolation of the isolated wellbore. The deflector may include a channel extending axially there through and a plug disposed in the channel and engaged with the channel to form a fluid and pressure tight seal. To resume fluid flow into or out of the isolated wellbore, the isolation sleeve may be extracted and the plug may be removed from the deflector.

Figure 1:
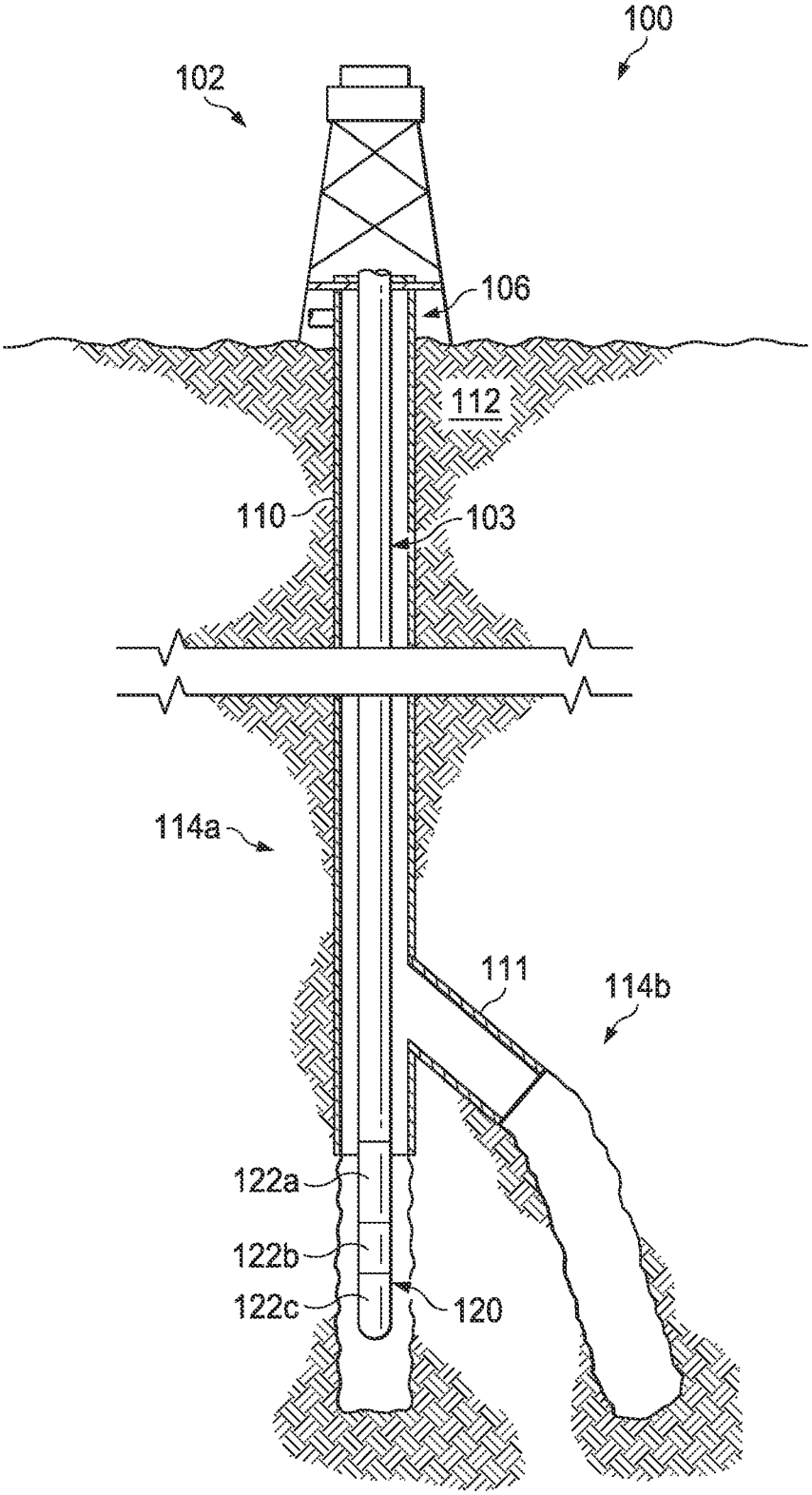
FIG. 1 is an elevation view of a well system.

FIG. 1 is an elevation view of an example embodiment of a well system. Well system 100 may include well surface or well site 106. Various types of equipment such as a rotary table, drilling fluid or production fluid pumps, drilling fluid tanks (not expressly shown), and other drilling or production equipment may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Well system 100 may also include production string 103, which may be used to produce hydrocarbons such as oil and gas and other natural resources such as water from formation 112 via multilateral wellbore 114. Multilateral wellbore 114 may include a main wellbore 114*a* and a lateral wellbore 114*b*. As shown in FIG. 1, main wellbore 114*a* is substantially vertical (e.g., substantially perpendicular to the surface) and lateral wellbore 114*b* extends from main wellbore 114*a* at an angle. In other embodiments, portions of main wellbore 114*a* may be substantially horizontal (e.g., substantially parallel to the surface) or may extend at an angle between vertical (e.g., perpendicular to the surface) or horizontal (e.g., parallel to the surface). Similarly, portions of lateral wellbore 114*b* may be substantially vertical (e.g., substantially perpendicular to the surface), substantially horizontal (e.g., substantially parallel to the surface) or at an angle between vertical (e.g., perpendicular to the surface) or horizontal (e.g., parallel to the surface). Casing string 110 may be placed in main wellbore 114*a* and held in place by cement, which may be injected between casing string 110 and the sidewalls of main wellbore 114*a*. Casing string 110 may provide radial support to main wellbore 114*a*. Casing string 110 in conjunction with the cement injected between casing string 110 and the sidewalls of main wellbore 114*a* may seal against unwanted communication of fluids between main wellbore 114*a* and surrounding formation 112. Casing string 110 may extend from well surface 106 to a selected downhole location within main wellbore 114*a*.

Lateral casing string 111 may be placed in lateral wellbore 114*b* and held in place by cement, which may be injected between lateral casing string 111 and the sidewalls of lateral wellbore 114*b*. Lateral casing string 111 may provide radial support to lateral wellbore 114*b*. Additionally, lateral casing string 111 in conjunction with the cement injected between lateral casing string 111 and the sidewalls of lateral wellbore 114*b* may provide a seal to prevent unwanted communication of fluids between lateral wellbore 114*b* and surrounding formation 112. Alternatively, lateral casing string 111 in conjunction with isolation packers, such as open hole packers, may provide a seal to prevent unwanted communication of fluids between lateral wellbore 114*b* and surrounding formation 112. Lateral casting string 111 may extend from the intersection between main wellbore 114*a* and lateral wellbore 114*b* to a downhole location within lateral wellbore 114*b*. Portions of main wellbore 114*a* and lateral wellbore 114*b* that do not include casing string 110 may be described as "open hole."

The terms "uphole" and "downhole" may be used to describe the location of various components relative to the bottom or end of wellbore 114 shown in FIG. 1. For example, a first component described as uphole from a second component may be further away from the bottom or end of wellbore 114 than the second component. Similarly, a first component described as being downhole from a second component may be located closer to the bottom or end of wellbore 114 than the second component.

Well system 100 may also include downhole assembly 120 coupled to production string 103. Downhole assembly 120 may be used to perform operations relating to the completion of main wellbore 114*a*, the production of natural resources from formation 112 via main wellbore 114*a*, and/or the maintenance of main wellbore 114*a*. Downhole assembly 120 may be located at the end of main wellbore 114*a*, as shown in FIG. 1, or at a point uphole from the end of main wellbore 114*a* or lateral wellbore 114*b*. Downhole assembly 120 may be formed from a wide variety of components configured to perform these operations. For example, components 122*a*, 122*b* and 122*c* of downhole assembly 120 may include, but are not limited to, screens, flow control devices, such as in-flow control devices (ICDs), flow control valves, guide shoes, float shoes, float collars, sliding sleeves, perforators, downhole permanent gauges, landing nipples, perforating guns, and fluid loss control devices. The number and types of components 122 included in downhole assembly 120 may depend on the type of wellbore, the operations being performed in the wellbore, and anticipated wellbore conditions.

Although downhole assembly 120 is illustrated in main wellbore 114*a* in FIG. 1, downhole assembly 120 may also be located in lateral wellbore 114*b*. Downhole assembly 120 may be used to perform operations relating to the completion of lateral wellbore 114*b*, the production of natural resources from formation 112 via lateral wellbore 114*b*, and/or the maintenance of lateral wellbore 114*b*. Downhole assembly 120 may be located at the end of lateral wellbore 114*b* or at a point uphole from the end of lateral wellbore 114*b*.

Figure 2:
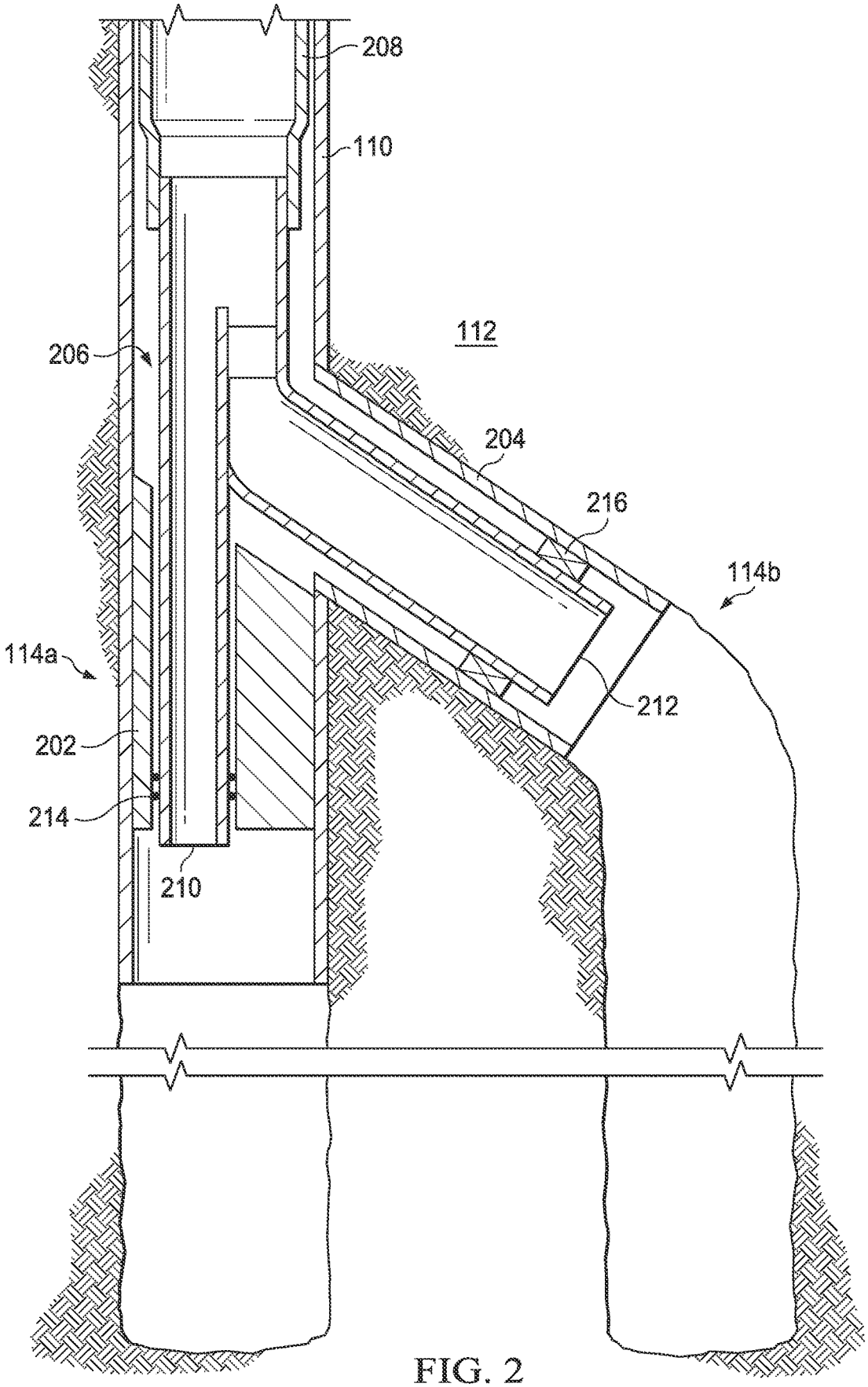
FIG. 2 is a cross-sectional view of a junction positioned at the intersection between a main wellbore and a lateral wellbore.

A junction may be installed at the intersection of main wellbore 114*a* and lateral wellbore 114*b* in order to seal and maintain pressure in main wellbore 114*a* and lateral wellbore 114*b*. FIG. 2 is a cross-sectional view of a junction installed at the intersection of main wellbore 114*a* and lateral wellbore 114*b*. Junction 206 may be installed at the intersection of main wellbore 114*a* and lateral wellbore 114*b*. The uphole end of junction 206 may engage with liner 208 that extends uphole from junction 206. Junction 206 may engage with liner 208 to form a fluid and pressure tight seal. The downhole end of junction 206 may include two legs—main leg 210 and lateral leg 212. Main leg 210 may extend into main wellbore 114*a* downhole from the intersection with lateral wellbore 114*b* and engage with completion deflector 202 to form a fluid and pressure tight seal. For example, main leg 210 of junction 206 may include seals 214 that engage with the inner surface of completion deflector 202 to form a fluid and pressure tight seal. Lateral leg 212 may extend into lateral wellbore 114*b* and may engage with lateral casing string 204 to form a fluid and pressure tight seal. In some embodiments, lateral leg 212 may include swell packers 216 that engage with lateral casing 204 to form a fluid and pressure tight seal. In other embodiments, an alternative sealing mechanism may be used. Once junction 206 is installed and engaged with both completion deflector 202 and lateral casing string 204, a fluid and pressure tight seal may be maintained with both main wellbore 114*a* and lateral wellbore 114*b*.

Figure 3:
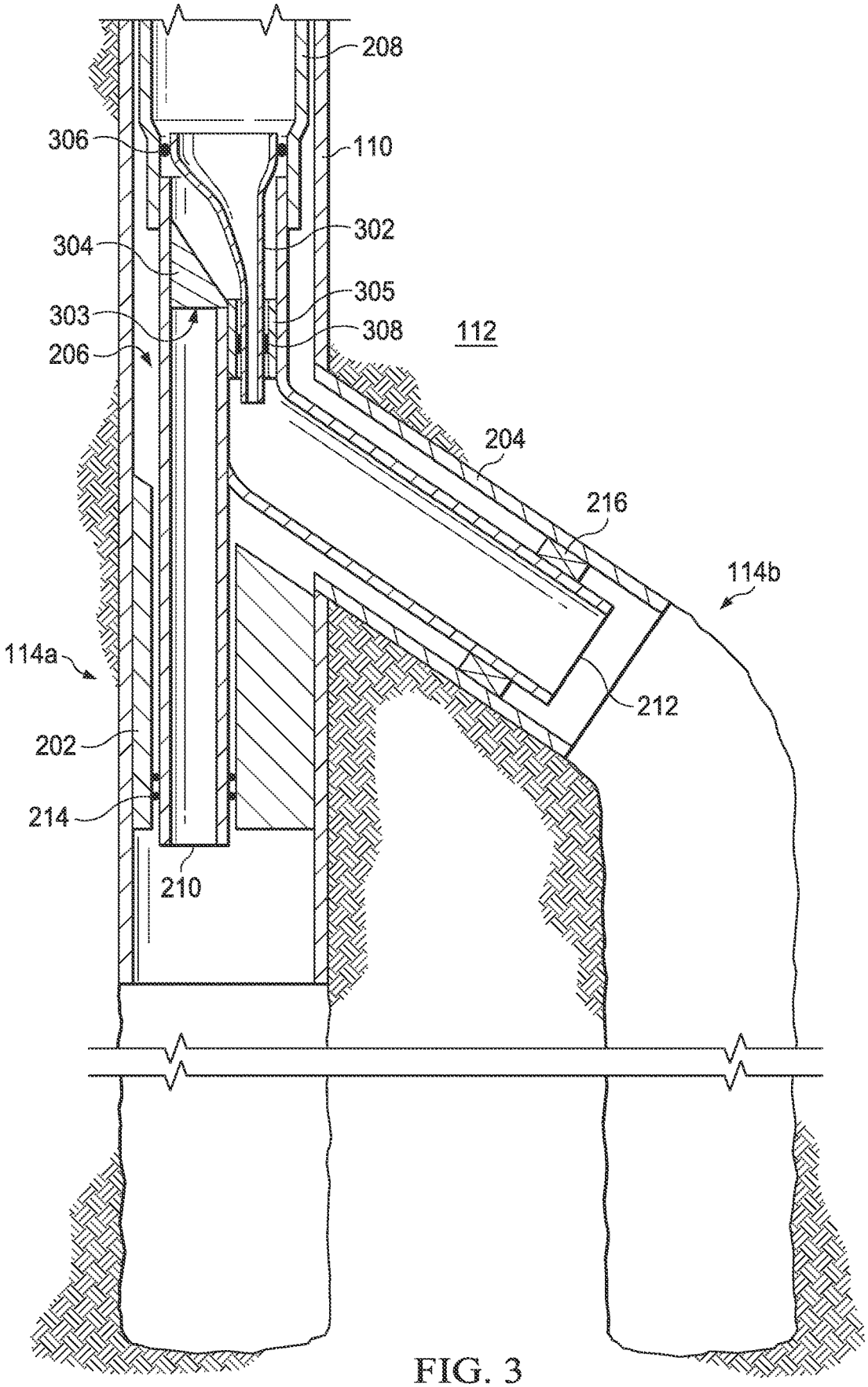
FIG. 3 is a cross-sectional view of an isolation sleeve and a deflector used to isolate a wellbore.

At various times during production and/or maintenance operations within multilateral wellbore 114, a branch of multilateral wellbore 114 (e.g., main wellbore 114*a* or lateral wellbore 114*b*) may be temporarily isolated from pressure and/or debris caused by operations in another branch of multilateral wellbore 114. Examples of such operations include, but are not limited to, gravel packing, fracture packing, acid stimulation, conventional fracture treatments, or cementing a casing or liner, or other similar operations. As shown in FIG. 3, an isolation sleeve positioned at the intersection of main wellbore 114*a* and lateral wellbore 114*b* may be used to temporarily isolate one branch of multilateral wellbore 114 from debris and pressure caused by operations in the other branch of multilateral wellbore 114. For example, if main wellbore 114*a* is isolated, an isolation sleeve may be used to temporarily prevent fluid flow into and out of main wellbore 114*a*, but permit fluid flow into and out of lateral wellbore 114*b*. Similarly, if lateral wellbore 114*b* is isolated, an isolation sleeve may be used to temporarily prevent fluid flow into and out of lateral wellbore 114*b*, but permit fluid flow into and out of main wellbore 114*a*.

FIG. 3 is a cross-sectional view of an isolation sleeve and a deflector used to isolate a wellbore. To isolate main wellbore 114*a*, deflector 303 may be positioned within junction 206 such that the path into main wellbore 114*a* is obstructed and downhole tools inserted into junction 206 (including isolation sleeve 302) are deflected into lateral leg 212 of junction 206 and thus into lateral wellbore 114*b*. Deflector 303 may include body 304 and, in some embodiments, sealing sleeve 305. Deflector 303 may positioned such that body 304 obstructs the path into main wellbore 114*a* and downhole tools inserted into junction 206 (including isolation sleeve 302) are deflected by body 304 into lateral leg 212 of junction 206 and thus into lateral wellbore 114*b*. Sealing sleeve 305 may extend into and engage lateral leg 212 of junction 206 to form a fluid and pressure tight seal. Sealing sleeve 305 may include a polished inner surface to permit isolation sleeve 302 or other downhole tools to be coupled to sealing sleeve 305 in a fluid-tight and pressure-tight manner.

Isolation sleeve 302 may be inserted into junction 206 and may contact deflector 304 such that isolation sleeve is deflected into lateral leg 212 of junction 206. Isolation sleeve 302 may engage with liner 208 and with either lateral leg 212 of junction 206 or sealing sleeve 305 to form a fluid and pressure tight seal, thereby isolating main wellbore 114*a* from pressure experienced in lateral wellbore 114*b* and from fluid and debris circulating in lateral wellbore 114*b*. Isolation sleeve 302 may include two sets of seals—uphole seals 306 and downhole seals 308. Uphole seals 306 may be disposed on the uphole end of isolation sleeve 302 and may engage with liner 208 to form a fluid and pressure tight seal. Although two uphole seals 306 are depicted for illustrative purposes, any number of uphole seals 306 may be used. In some embodiments, uphole seals 306 may be a molded seal made of an elastomeric material. The elastomeric material may be compounds including, but not limited to, natural rubber, nitrile rubber, hydrogenated nitrile, urethane, polyurethane, fluorocarbon, perfluorocarbon, propylene, neoprene, hydrin, etc. In other embodiments, uphole seals 306 may be a metal sealing mechanism, including but not limited to metallic c-seals, spring energized seals, e-seals, lip seals, boss seals, and o-seals.

Downhole seals 308 may be disposed on the downhole end of isolation sleeve 302 and may engage with lateral leg 212 of junction 206 to form a fluid and pressure tight seal. For example, downhole seals 308 may engage with polished inner surface 310 of lateral leg 212 of junction 206 (shown in FIG. 4). Alternatively, in embodiments where sealing sleeve 305 is present, downhole seals may engage with the polished inner surface of sealing sleeve 305 to form a fluid and pressure tight seal. Although two downhole seals 308 are depicted for illustrative purposes, any number of downhole seals 308 may be used. In some embodiments, downhole seals 308 may be a molded seal made of an elastomeric material. The elastomeric material may be compounds including, but not limited to, natural rubber, nitrile rubber, hydrogenated nitrile, urethane, polyurethane, fluorocarbon, perfluorocarbon, propylene, neoprene, hydrin, etc. In other embodiments, downhole seals 308 may be a metal sealing mechanism, including but not limited to metallic c-seals, spring energized seals, e-seals, lip seals, boss seals, and o-seals. Isolation sleeve 302 may be extracted from the wellbore to permit fluid flow into and out of main wellbore 114*a* to resume.

Although FIG. 3 illustrates the use of isolation sleeve 302 to isolate main wellbore 114*a*, isolation sleeve 302 may also be used to isolate lateral wellbore 114*b*. For example, deflector 304 may be positioned within junction 206 such that such the path into lateral wellbore 114*b* is obstructed and downhole tools inserted into junction 206 (including isolation sleeve 302) are deflected into main leg 210 of junction 206 and thus into main wellbore 114*a*. Isolation sleeve 302 may be inserted into junction 206 and may contact deflector 304. When isolation sleeve 302 contacts deflector 304 it may be deflected into main leg 210 of junction 206. Isolation sleeve 302 may engage with liner 208 and with either main leg 210 of junction 206 or sealing sleeve 305 to form a fluid and pressure tight seal, thereby isolating lateral wellbore 114*b* from pressure experienced in main wellbore 114*a* and from fluid and debris circulating in main wellbore 114*a*. Specifically, uphole seals 306 may engage with liner 208 to form a fluid and pressure tight seal and downhole seals 308 may engage with either a polished inner surface of main leg 210 of junction 206 or the polished inner surface of sealing sleeve 305 to form a fluid and pressure tight seal. Deflector 303 and isolation sleeve 302 may be extracted from the wellbore to permit fluid flow into and out of lateral wellbore 114*b* to resume.

Figure 4:
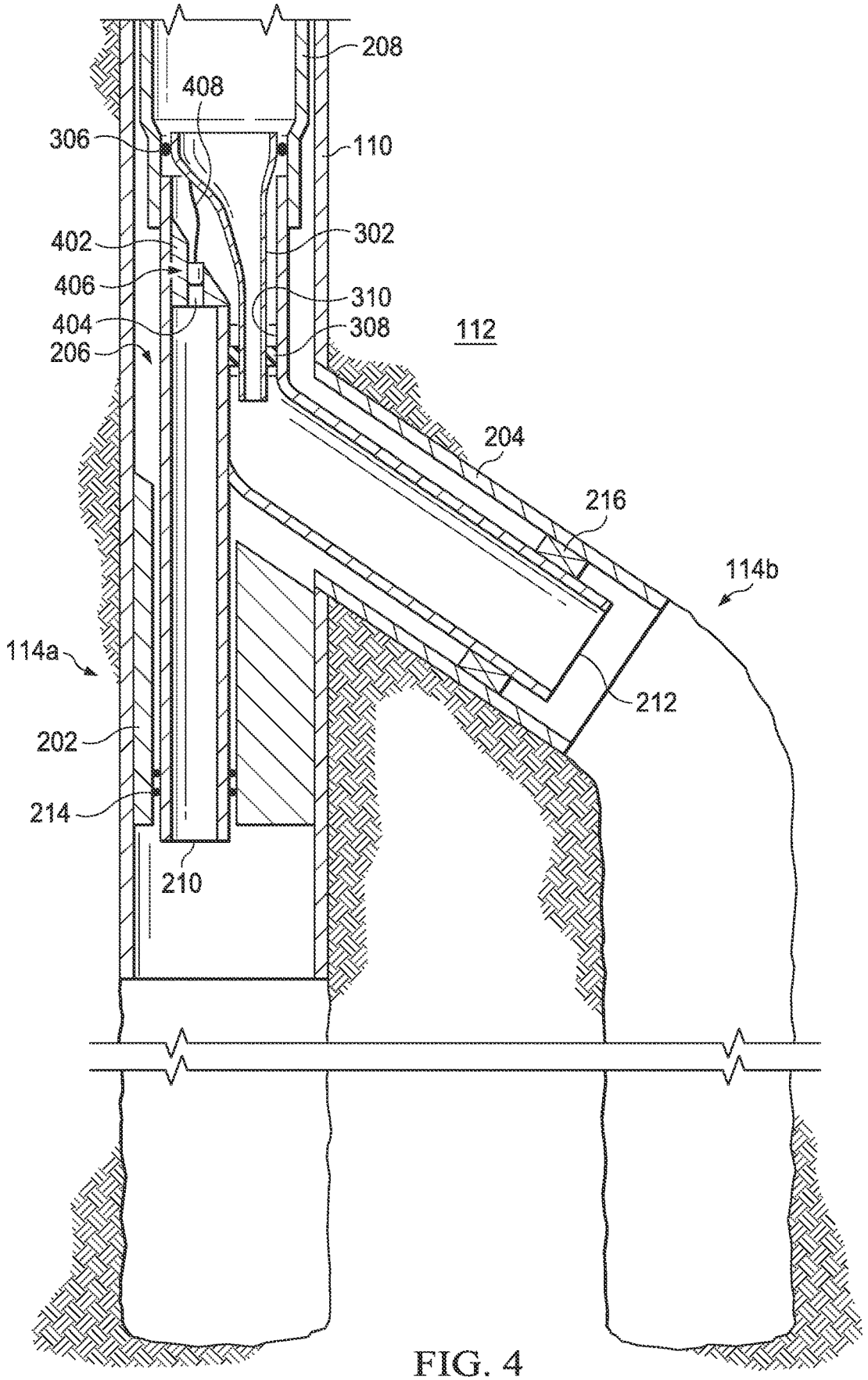
FIG. 4 is a cross-sectional view of an isolation sleeve and a deflector including a plug used to isolate a wellbore.

FIG. 4 is a cross-sectional view of an isolation sleeve and a deflector including a plug used to isolate a wellbore. Deflector 402 may be positioned within junction 206 such that such that the path into main wellbore 114*a* is obstructed and downhole tools inserted into junction 206 (including isolation sleeve 302) are deflected into lateral leg 212 of junction 206 and thus lateral wellbore 114*b*. Unlike deflector 303 (shown in FIG. 3), deflector 402 may engage with main leg 210 of junction 206 to form a fluid and pressure tight seal, thereby preventing fluid flow into and out of main wellbore 114*a*. The seal formed between deflector 402 and main leg 210 of junction 206 may permit isolation of main wellbore 114*a* even if isolation sleeve 302 fails to form or maintain a fluid and pressure tight seal.

Isolation sleeve 302 may be inserted into junction 206 and may contact deflector 402. When isolation sleeve 302 contacts deflector 402 it may be deflected into lateral leg 212 of junction 206. Isolation sleeve 402 may engage with both liner 208 and lateral leg 212 of junction 206 to form a fluid and pressure tight seal, thereby isolating main wellbore 114*a* from pressure experienced in lateral wellbore 114*b* and from fluid and debris circulating in lateral wellbore 114*b*. As discussed above with respect to FIG. 3, isolation sleeve 302 may include two sets of seals—uphole seals 306 and downhole seals 308. Uphole seals 306 may engage with liner 208 to form a fluid and pressure tight seal and downhole seals 308 may engage with polished inner surface 310 of lateral leg 212 to form a fluid and pressure tight seal. Deflector 402 may include channel 404 extending axially there through and plug 406 disposed in channel 404. Plug 406 may engage with channel 404 to form a fluid and pressure tight seal. Isolation sleeve 302 may be extracted from the wellbore and plug 406 may be removed from deflector 402 to permit fluid flow into and out of main wellbore 114*a* to resume.

Plug 406 may be mechanically removed from deflector 402 and extracted from the wellbore with isolation sleeve 302. For example, plug 406 may be removed from deflector 402 using a retrieval tool inserted into the wellbore following or in conjunction with the extraction of isolation sleeve 302. As another example, plug 406 may be coupled to isolation sleeve 302 via cable 408 such that extraction of isolation sleeve 302 causes plug 406 to be removed from deflector 402.

Alternatively, plug 406 may be degradable and may be removed from deflector 402 using a chemical reaction that causes plug 406 to degrade. Once the chemical reaction causing plug 406 to degrade has been triggered, the reaction may continue until plug 406 breaks down into pieces or dissolves into particles small enough that they do not impede the flow of fluids through channel 404 extending through deflector 402. When plug 406 has degraded to this point, fluids may flow into and out of main wellbore 114*a* via channel 404. The features of a degradable plug are discussed in more detail with respect to FIGS. 5A-5D.

To avoid removing plug 406 altogether (either mechanically or via chemical reaction), plug 406 may include a flapper or valve that may be triggered to open to permit fluid flow into and out of main wellbore 114*a* to resume. As an example, plug 406 may include a flapper or valve that may be triggered to open at a particular pressure or temperature. As another example, plug 406 may include a flapper or valve that may be triggered to open after a predetermined time in operation. As yet another example, plug 406 may be configured to receive a signal that triggers a flapper or valve included in plug 406 to open upon receipt of the signal. The signal may include an electromagnetic signal, an acoustic signal, a pressure pulse or pressure sequence, or an RFID signal. As still another example, plug 406 may be triggered to open by contact with a mechanical tool inserted into wellbore 114, such as a shifting tool.

Although FIG. 4 illustrates the use of isolation sleeve 302 to isolate main wellbore 114*a*, isolation sleeve 302 may also be used to isolate lateral wellbore 114*b*. For example, deflector 402 may be positioned within junction 206 such that the path into lateral wellbore 114*b* is obstructed and downhole tools inserted into junction 206 (including isolation sleeve 302) are deflected into main leg 210 of junction 206 and thus into main wellbore 114*a*. Deflector 402 may engage with lateral leg 212 of junction 206 to form a fluid and pressure tight seal. Isolation sleeve 302 may be inserted into junction 206 and may contact deflector 402. When isolation sleeve 302 contacts deflector 402 it may be deflected into main leg 210 of junction 206.

Isolation sleeve 302 may engage with both liner 208 and main leg 210 of junction 206 to form a fluid and pressure tight seal, thereby isolating lateral wellbore 114*b* from pressure experienced in main wellbore 114*a* and from fluid and debris circulating in main wellbore 114*a*. Specifically, uphole seals 306 may engage with liner 208 to form a fluid and pressure tight seal and downhole seals 308 may engage with a polished inner surface of main leg 210 of junction 206 to form a fluid and pressure tight seal. The seal formed between deflector 402 and lateral leg 212 of junction 206 may permit isolation of lateral wellbore 114*b* even if uphole seals 306 and downhole seals 308 of isolation sleeve 302 fail to form or maintain a fluid and pressure tight seal with liner 208 and main leg 210 of junction 206. Isolation sleeve 302 may be extracted from the wellbore, and plug 406 may be removed from deflector 402 (either mechanical or via a chemical or electrochemical reaction) or a valve included in plug 406 may be opened to permit fluid flow into and out of lateral wellbore 114*b* to resume.

Although FIGS. 3-4 illustrate positioning a deflector and an isolation sleeve in a junction after the junction has been positioned at the intersection of a main wellbore and a lateral wellbore, the deflector and the isolation sleeve may be pre-installed in the junction before the junction is positioned at the intersection of the main wellbore and the lateral wellbore. In such circumstances, the deflector may be pre-installed in the junction such that the path into the leg of the junction corresponding to the wellbore to be isolated is obstructed and the isolation sleeve may be pre-installed in the leg of the junction corresponding to the non-isolated wellbore. For example, if the main wellbore is to be isolated, the deflector may be pre-installed in the junction prior to lowering the junction into the wellbore such that the path into the main leg of the junction is obstructed and the isolation sleeve may be pre-installed in the lateral leg of the junction. Similarly, if the lateral wellbore is to be isolated, the deflector may be pre-installed in the junction prior to lowering the junction into the wellbore such that the path into the lateral leg of the junction is obstructed and the isolation sleeve may be pre-installed in the main leg of the junction. Once the deflector and the isolation sleeve have been pre-installed in the junction, the junction may be positioned at the intersection of the main wellbore and the lateral wellbore such that the main leg of the junction extends downhole into the main wellbore and the lateral leg of the junction extends downhole into the lateral wellbore.

Figure 5A:
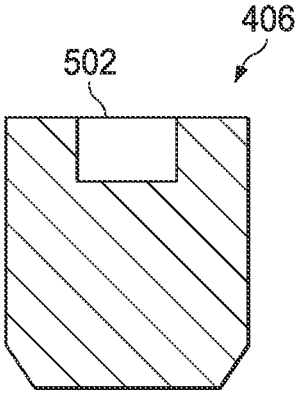
FIG. 5A is a cross-sectional view of a degradable plug formed of a degradable composition that is reactive under defined conditions.

FIGS. 5A-5D illustrate exemplary embodiments of a degradable plug. FIG. 5A is a cross-sectional view of a degradable plug formed of degradable composition that is reactive under defined conditions. Plug 406 may include socket 502 that may be configured to engage with a tool to permit plug 406 to be positioned within or extracted from deflector 402 (shown in FIG. 4). Plug 406 may be formed of a degradable composition including a metal or alloy that is reactive under defined conditions. The composition of plug 406 may be selected such that plug 406 begins to degrade within a predetermined time of first exposure to a corrosive or acidic fluid due to reaction of the metal or alloy from which plug 406 is formed with the corrosive or acidic fluid. The composition of plug 406 may further be selected such that plug 406 degrades sufficiently to form pieces or particles small enough that they do not impede the flow of fluids through channel 404 of deflector 402 (shown in FIG. 4). The corrosive or acidic fluid may already be present within the wellbore during operation or may be injected into the wellbore to trigger a chemical reaction that causes plug 406 to degrade. The corrosive or acidic fluid may include fluids formed of a solution including but not limited to hydrochloric acid (HCl), formic acid (HCOOH), acetic acid (CH3COOH), or hydrofluoric acid (HF). Exemplary compositions from which plug 406 may be formed include compositions in which the metal or alloy is selected from one of calcium, magnesium, aluminum, and combinations thereof.

Plug 406 may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of fluids through channel 404 of deflector 402 (shown in FIG. 4). When the metal or alloy degrades, the small particles of the non-reactive material may remain. The particle size of the non-reactive material may be selected such that the particles are small enough that they do not impede the flow of fluids through channel 404 of deflector 402 (shown in FIG. 4). The non-reactive material may be selected from one of lithium, bismuth, calcium, magnesium, and aluminum (including aluminum alloys) if not already selected as the reactive metal or alloy, and combinations thereof.

Plug 406 may also be formed from the metal or alloy imbedded with small particles (e.g., particulates, powders, flakes, fibers, and the like) to form a galvanic cell. The composition of the particles may be selected such that the metal from which the particles are formed has a different galvanic potential than the metal or alloy in which the particles are imbedded. Contact between the particles and the metal or alloy in which they are imbedded may trigger microgalvanic corrosion that causes plug 406 to degrade. Exemplary compositions from which the particles may be formed include steel, aluminum alloy, zinc, magnesium, and combinations thereof.

Plug 406 may also be formed from an anodic material imbedded with small particles of a cathodic material. The anodic and cathodic materials may be selected such that plug 406 begins to degrade upon exposure to an electrolytic fluid, which may also be referred to as a brine, due to an electrochemical reaction that causes the plug to corrode. Exemplary compositions from which the anodic material may be formed include one of magnesium, aluminum, and combinations thereof. Exemplary compositions from which the cathodic material may be formed include one of iron, nickel, and combinations thereof. The anodic and cathodic materials may be selected such that plug 406 is degraded sufficiently within a predetermined time of first exposure to the electrolytic fluid to form pieces or particles small enough that they do not impede the flow of fluids through channel 404 of deflector 402 (shown in FIG. 4). The electrolytic fluid may already be present within the wellbore during operation or may be injected into the wellbore to trigger an electrochemical reaction that causes plug 406 to degrade.

Plug 406 may include a coating to temporarily protect the metal or alloy from exposure to the corrosive, acidic, or electrolytic fluid. As an example, plug 406 may be coated with a material that melts when a threshold temperature is reached in main leg 210 of junction 206 (shown in FIGS. 2-4). After the coating melts, the surface of plug 406 may be exposed to the corrosive, acidic, or electrolytic fluid circulating in the wellbore. As another example, plug 406 may be coated with a material that fractures when exposed to a threshold pressure. The threshold pressure may be a pressure greater than a pressure that occurs during operation of the wellbore. The pressure in the wellbore may be manipulated such that it exceeds the threshold pressure, causing the coating to fracture. When the coating fractures, the surface of plug 406 may be exposed to the corrosive, acidic, or electrolytic fluid circulating in the wellbore. Exemplary coatings may be selected from a metallic, ceramic, or polymeric material, and combinations thereof. The coating may have low reactivity with the corrosive, acidic, or electrolytic fluid present in the wellbore, such that it protects plug 406 from degradation until the coating is compromised allowing the corrosive, acidic, or electrolytic fluid to contact the metal or alloy.

Figure 5B:
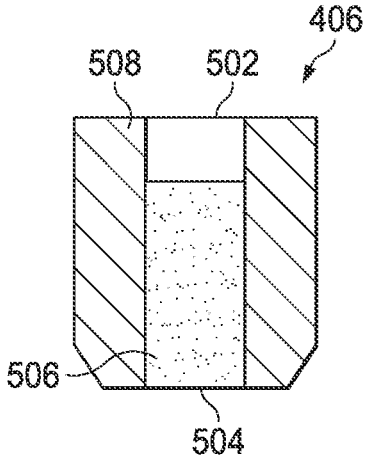
FIG. 5B is a cross-sectional view of a degradable plug including a shell and a core disposed within the shell and formed of a degradable composition that is reactive under defined conditions.

FIG. 5B is a cross-sectional view of a degradable plug including a shell and a core disposed within the shell and formed of a degradable composition that is reactive under defined conditions. Plug 406 may include socket 502 that may be configured to engage with a tool to permit plug 406 to be positioned within or extracted from deflector 402 (shown in FIG. 4). Plug 406 may also include core 504 disposed within channel 506 extending axially through shell 508. Core 504 may be removed from shell 508 by a chemical reaction that causes core 504 to degrade. Socket 502 may be open to channel 506 such that, when core 504 is removed from shell 508, fluid may flow through plug 406 via socket 502 and channel 506.

Core 504 may be formed of a degradable composition including a metal or alloy that is reactive under defined conditions. The composition of core 504 may be selected such that core 504 begins to degrade within a predetermined time of first exposure to a corrosive or acidic fluid due to reaction of the metal or alloy from which core 504 is formed with the corrosive or acidic fluid. The composition of core 504 may be selected such that core 504 degrades sufficiently to form pieces or particles small enough that they do not impede the flow of production fluids through channel 506. The corrosive or acidic fluid may already be present within the wellbore during operation or may be injected into the wellbore to trigger a chemical reaction that causes core 504 to degrade. The corrosive or acidic fluid may include fluids formed of a solution including but not limited to hydrochloric acid (HCl), formic acid (HCOOH), acetic acid (CH3COOH), or hydrofluoric acid (HF). Exemplary compositions from which core 504 may be formed include compositions in which the metal or alloy is selected from one of calcium, magnesium, aluminum, and combinations thereof.

Core 504 may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of production fluids through channel 506. When the metal or alloy degrades, the small particles of the non-reactive material may remain. The particle size of the non-reactive material may be selected such that the particles are small enough that they do not impede the flow of production fluids through channel 506. The non-reactive material may be selected from one of lithium, bismuth, calcium, magnesium, and aluminum (including aluminum alloys) if not already selected as the reactive metal or alloy, and combinations thereof.

Core 504 may also be formed from the metal or alloy imbedded with small particles (e.g., particulates, powders, flakes, fibers, and the like) to form a galvanic cell. The composition of the particles may be selected such that the metal from which the particles are formed has a different galvanic potential than the metal or alloy in which the particles are imbedded. Contact between the particles and the metal or alloy in which they are imbedded may trigger microgalvanic corrosion that causes core 504 to degrade. Exemplary compositions from which the particles may be formed include steel, aluminum alloy, zinc, magnesium, and combinations thereof.

Core 504 may also be formed from an anodic material imbedded with small particles of a cathodic material. The anodic and cathodic materials may be selected such that core 504 begins to degrade upon exposure to an electrolytic fluid, which may also be referred to as a brine, due to an electrochemical reaction that causes the plug to corrode. Exemplary compositions from which the anodic material may be formed include one of magnesium, aluminum, and combinations thereof. Exemplary compositions from which the cathodic material may be formed include one of iron, nickel, and combinations thereof. The anodic and cathodic materials may be selected such that core 504 is degraded sufficiently within a predetermined time of first exposure to the electrolytic fluid to form pieces or particles small enough that they do not impede the flow of production fluids through channel 506. The electrolytic fluid may already be present within the wellbore during operation or may be injected into the wellbore to trigger an electrochemical reaction that causes core 504 to degrade.

Core 504 may include a coating to temporarily protect the metal or alloy from exposure to the corrosive, acidic, or electrolytic fluid. As an example, core 504 may be coated with a material that melts when a threshold temperature is reached in main leg 210 of junction 206 (shown in FIGS. 2-4). After the coating melts, the surface of core 504 may be exposed to the corrosive, acidic, or electrolytic fluid circulating in the wellbore. As another example, core 504 may be coated with a material that fractures when exposed to a threshold pressure. The threshold pressure may be a pressure greater than a pressure that occurs during operation of the wellbore. The pressure in the wellbore may be manipulated such that it exceeds the threshold pressure, causing the coating to fracture. When the coating fractures, the surface of core 504 may be exposed to the corrosive, acidic, or electrolytic fluid circulating in the wellbore. Exemplary coatings may be selected from a metallic, ceramic, or polymeric material, and combinations thereof. The coating may have low reactivity with the corrosive or acidic fluid present in the wellbore, such that it protects core 504 from degradation until the coating is compromised allowing the corrosive, acidic, or electrolytic to contact the metal or alloy.

Shell 508 may be formed of a non-reactive material. The non-reactive material may be selected such that it remains structurally intact even when exposed to the corrosive or acidic fluid for a duration of time sufficient to degrade the metal or alloy from which core 504 is formed into pieces or particles small enough that they do not impede the flow of production fluids through channel 506 of plug 406.

Figure 5C:
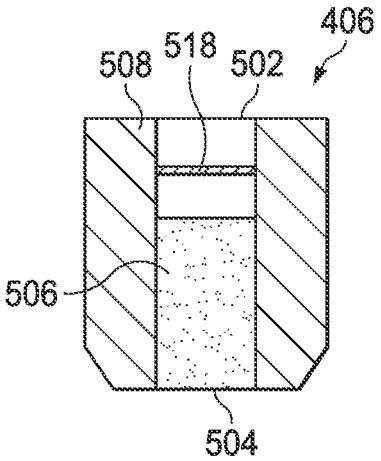
FIG. 5C is a cross-sectional view of a degradable plug including a shell, a core disposed within the shell and formed of a degradable composition that is reactive under defined conditions, and a rupture disk.

FIG. 5C is a cross-sectional view of a degradable plug including a shell, a core disposed within the shell and formed of a degradable composition that is reactive under defined conditions, and a rupture disk. Plug 406 may include socket 502 that may be configured to engage with a tool to permit plug 406 to be positioned within or extracted from deflector 402 (shown in FIG. 4). Plug 406 may also include core 504 disposed within channel 506 extending axially through shell 508. As discussed above with respect to FIG. 5B, core 504 may be removed from shell 508 using a chemical or electrochemical reaction that causes core 504 to degrade. Socket 502 may be open to channel 506 such that, when core 504 is removed from shell 508, fluid may flow through plug 406 via socket 502 and channel 506.

Plug 406 may further include rupture disk 518 that temporarily protects core 504 from degradation until rupture disk 518 is compromised allowing the corrosive, acidic, or electrolytic fluid to contact the metal or alloy. Rupture disk 518 may be formed of a material that fractures when exposed to a threshold pressure. The threshold pressure may be a pressure greater than a pressure that occurs during operation of the wellbore. The pressure in the wellbore may be manipulated such that it exceeds the threshold pressure, causing rupture disk 518 to fracture. Alternatively, rupture disk 518 may include an actuator that causes rupture disk 518 to fracture. When rupture disk 518 fractures, the surface of core 504 may be exposed to the corrosive, acidic, or electrolytic fluid circulating in or injected into the wellbore. As discussed above with respect to FIG. 5B, exposure to the corrosive, acidic, or electrolytic fluid may trigger a chemical or electrochemical reaction that causes core 504 to degrade.

As discussed above with respect to FIG. 5B, shell 508 may be formed of a non-reactive material that remains structurally intact even when exposed to the corrosive or acidic fluid for a duration of time sufficient to degrade core 504 is formed into pieces or particles small enough that they do not impede the flow of production fluids through channel 506.

Figure 5D:
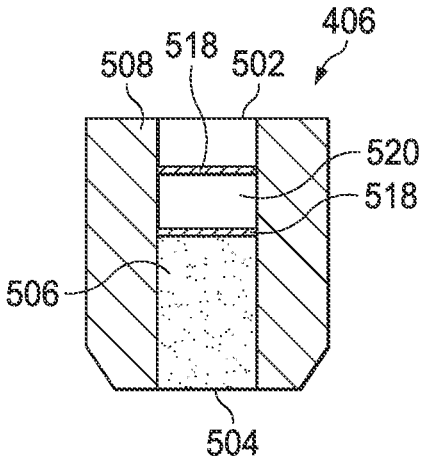
FIG. 5D is a cross-sectional view of a degradable plug including a shell, a core disposed within the shell and formed of a degradable composition that is reactive under defined conditions, a pair of rupture disks, and a fluid reservoir.

FIG. 5D is a cross-sectional view of a degradable plug including a shell, a core disposed within the shell and formed of a degradable composition that is reactive under defined conditions, a pair of rupture disks, and a fluid reservoir. Plug 406 may include socket 502 that may be configured to engage with a tool to permit plug 406 to be positioned within or extracted from deflector 402 (shown in FIG. 4). Plug 406 may also include core 504 disposed within channel 506 extending axially through shell 508. As discussed above with respect to FIG. 5B, core 504 may be removed from shell 508 using a chemical or electrochemical reaction that causes core 504 to degrade. Socket 502 may be open to channel 506 such that, when core 504 is removed from shell 508, fluid may flow through plug 406 via socket 502 and channel 506.

Plug 406 may further include a pair or rupture disks 518 separated from one another such that fluid reservoir 520 is formed within channel 506 in the space separating rupture disks 518. Rupture disks may temporarily protect core 504 from degradation until rupture disks 518 are compromised allowing a corrosive, acidic, or electrolytic fluid disposed in fluid reservoir 520 to contact the metal or alloy. Rupture disks 518 may be formed of a material that fractures when exposed to a threshold pressure. The threshold pressure may be a pressure greater than a pressure that occurs during operation of the wellbore. The pressure in the wellbore may be manipulated such that it exceeds the threshold pressure, causing rupture disks 518 to fracture. Alternatively, rupture disks 518 may include an actuator that causes rupture disks 518 to fracture. When rupture disks 518 fracture, the surface of core 504 may be exposed to the corrosive, acidic, or electrolytic fluid disposed in fluid reservoir 520. As discussed above with respect to FIG. 5B, exposure to the corrosive, acidic, or electrolytic fluid may trigger a chemical or electrochemical reaction that causes core 504 to degrade.

As discussed above with respect to FIG. 5B, shell 508 may be formed of a non-reactive material that remains structurally intact even when exposed to the corrosive, acidic, or electrolytic fluid for a duration of time sufficient to degrade core 504 is formed into pieces or particles small enough that they do not impede the flow of production fluids through channel 506.

Figure 6:
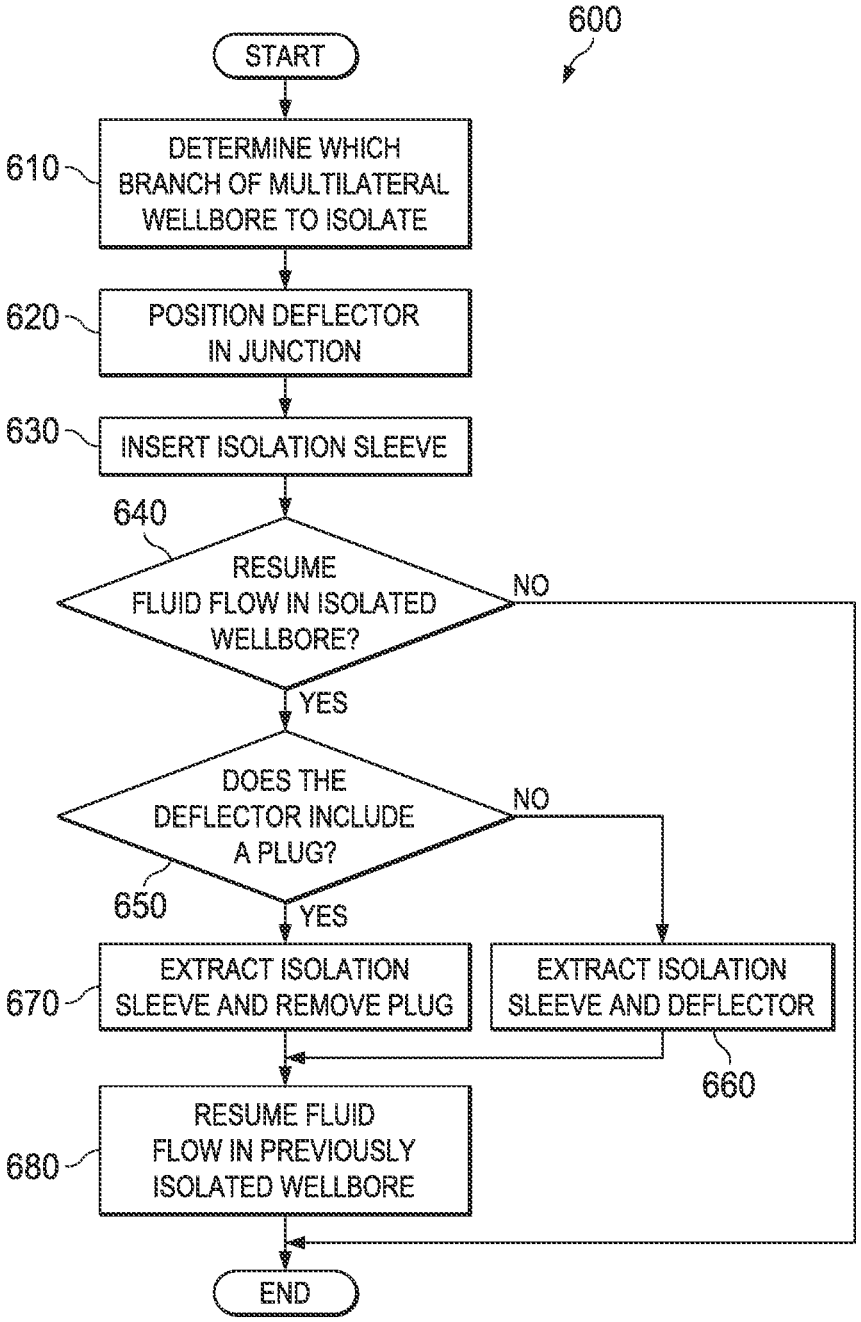
FIG. 6 is a flow chart of a method of isolating a main wellbore.

FIG. 6 is a flow chart for a method of isolating a wellbore by temporarily preventing the flow of fluids into or out of the wellbore. Method 600 may begin, and at step 610, a determination may be made regarding which branch of a multilateral wellbore should be isolated.

At step 620, a deflector may be positioned within a junction. As discussed above with respect to FIGS. 2-4, the junction may include two branches—a main leg extending downhole into the main wellbore from the intersection of the main wellbore and the lateral wellbore, and a lateral leg extending downhole into the lateral wellbore from the intersection of the main wellbore and the lateral wellbore. As discussed above with respect to FIG. 3, the deflector may include a body and, in some embodiments, a sealing sleeve. The deflector may be positioned in the junction such that the body of the deflector obstructs the path into the leg of the junction corresponding with the branch of the multilateral wellbore to be isolated. For example, if the main wellbore is to be isolated, the deflector may be positioned in the junction such that the body of the deflector obstructs the path into the main leg of the junction. In contrast, if the lateral wellbore is to be isolated, the deflector may be positioned in the junction such that the body of the deflector obstructs the path into the lateral leg of the junction. The sealing sleeve may extend into and engage the leg of the junction corresponding with the branch of the multilateral wellbore that is not to be isolated to form a fluid and pressure tight seal.

As discussed above with respect to FIG. 4, the deflector may engage with the junction to form a fluid and pressure tight seal, thereby preventing fluid flow into and out of the isolated branch of the multilateral wellbore. The seal formed between the deflector and the junction may permit isolation a branch of the multilateral wellbore even if the isolation sleeve fails to form or maintain a fluid and pressure tight seal.

At step 630, an isolation sleeve may be positioned in the junction. When the isolation sleeve enters the junction, it may contact the deflector and be deflected away from the leg of the junction corresponding to the wellbore to be isolated. For example, as shown in FIGS. 3 and 4, if the main wellbore is to be isolated, the isolation sleeve may contact the deflector and be deflected away from the main leg of the junction and into the lateral leg of the junction. In contrast, if the lateral wellbore is to be isolated, the isolation sleeve may contact the deflector and be deflected away from the lateral leg of the junction and into the main leg of the junction.

The uphole and downhole ends of the isolation sleeve may form fluid and pressure tight seals that prevent the flow of fluids into or out of the wellbore to be isolated. As discussed above with respect to FIGS. 3 and 4, the isolation sleeve may include multiple sets of seals—uphole seals disposed on the uphole end of the isolation sleeve and downhole seals disposed on the downhole end of the isolation sleeve. The uphole seals of the isolation sleeve may engage with the liner uphole from the junction. The downhole seals may engage with either the leg of the junction corresponding to the wellbore that is not to be isolated or the sealing sleeve of the deflector to form a fluid and pressure tight seal. For example, as discussed above with respect to FIGS. 3-4, if the main wellbore is to be isolated, the downhole seals may engage with either the lateral leg of the junction or the sealing sleeve of the deflector to form a fluid and pressure tight seal, thereby isolating the main wellbore from pressure experienced in the lateral wellbore and from fluid and debris circulating in the lateral wellbore. Alternatively, if the lateral wellbore is to be isolated, the downhole seals may engage with either the main leg of the junction or the sealing sleeve of the deflector to form a fluid and pressure tight seal, thereby isolating the lateral wellbore from pressure experienced in the main wellbore and from fluid and debris circulating in the main wellbore.

Steps 620 and 630 may take place before or after the junction is lowered into the wellbore. For example, as discussed above, the deflector and the isolation sleeve may be pre-installed in the junction before the junction has been lowered into the wellbore or may be installed in the junction after the junction has been lowered into the wellbore and positioned at the intersection of the main wellbore and the lateral wellbore.

At step 640, a determination may be made regarding whether to resume fluid flow in the isolated wellbore. If it is determined not to resume fluid flow in the isolated wellbore and thus to continue isolation of the isolated wellbore, the method may end. If it is determined to resume fluid flow in the isolated wellbore, the method may proceed to step 650.

At step 650, a determination may be made regarding whether the deflector includes a plug. If the deflector does not include a plug, the method may proceed to step 660. At step 660, the isolation sleeve and the deflector may be extracted from the wellbore. When the isolation sleeve and the deflector have been extracted, the method may proceed to step 680 and fluid flow in the previously isolated wellbore may resume.

If the deflector does include a plug, the method may proceed to step 670. At step 670, the isolation sleeve may be extracted from the wellbore and the plug may be removed from the deflector. As discussed above with respect to FIG. 5, the deflector may include a channel extending axially there through and a plug disposed in the channel that engages with the channel to form a fluid and pressure tight seal. When a determination has been made to resume fluid flow in the isolated wellbore, the isolation sleeve may be extracted from the wellbore and the plug may be removed from the deflector. The plug may be mechanically removed from the deflector and extracted from the wellbore with the isolation sleeve.

Alternatively, the plug may be degradable and may be removed from the deflector by a chemical reaction that causes the plug to degrade. For example, as discussed above with respect to FIGS. 5A-5D, the plug may be formed of a degradable composition including a metal or alloy that is reactive under defined conditions. A chemical or electrochemical reaction causing the plug to degrade may be triggered and may continue until the plug breaks down into pieces or dissolves into particles small enough that they do not impede the flow of fluids through the channel extending through the deflector. Once the plug has been removed (either manually or by chemical or electrochemical reaction) or the valve has been opened, the method may proceed to step 680 and the flow of fluid into and out of the previously isolated wellbore may resume.

As discussed above with respect to FIG. 4, to avoid the time and expense associated with removing the plug from the deflector (either mechanically or via a chemical or electrochemical reaction), the plug may include a flapper valve that may be triggered to open to permit fluid flow into or out of the isolated wellbore to resume.

Modifications, additions, or omissions may be made to method 600 without departing from the scope of the present disclosure. For example, the order of the steps may be performed in a different manner than that described and some steps may be performed at the same time. Additionally, each individual step may include additional steps without departing from the scope of the present disclosure.

Embodiments disclosed herein include:

A. A wellbore isolation system that includes a junction positioned at an intersection of a first wellbore and a second wellbore, and a deflector disposed in the junction such that a path into the first leg of the junction is obstructed and engaged with the first leg of the junction to form a fluid and pressure tight seal. The junction includes a first leg extending downhole into the first wellbore, and a second leg extending downhole into the second wellbore. The deflector includes a channel extending axially through the deflector, and a degradable plug disposed in the channel and engaged with the channel to prevent fluid flow through the channel.

B. A method of temporarily isolating a wellbore that includes positioning a junction at an intersection of a first wellbore and a second wellbore, and positioning a deflector in the junction such that a path into the first leg of the junction is obstructed and the deflector engages the first leg of the junction to form a fluid and pressure tight seal. The junction includes a first leg extending downhole into the first wellbore, and a second leg extending downhole into the second wellbore. The deflector includes a channel extending axially through the deflector, and a degradable plug disposed in the channel and engaged with the channel to prevent fluid flow through the channel.

Each of embodiments A and B may have one or more of the following additional elements in any combination: Element 1: an isolation sleeve extending into the second leg of the junction and preventing fluid flow into and out of the first wellbore. Element 2: the uphole end of the isolation sleeve engages with a liner disposed uphole from the junction to form a fluid and pressure tight seal, and the downhole end of the isolation sleeve engages with the second leg of the junction to form a fluid and pressure tight seal. Element 3: the uphole end of the isolation sleeve engages with a liner disposed uphole from the junction to form a fluid and pressure tight seal, and the downhole end of the isolation sleeve engages with a sealing sleeve of the deflector extending downhole into the second leg of the junction to form a fluid and pressure tight seal. Element 4: wherein the degradable plug is formed of a composition that degrades within a predetermined time of exposure to a particular fluid. Element 5: wherein the degradable plug includes a degradable plug formed of a composition that degrades within a predetermined time of exposure to a particular fluid, and a coating formed around the plug that temporarily protects the plug from exposure to the particular fluid. Element 6: wherein the degradable plug includes a first composition imbedded with particles of a second composition to form a galvanic cell. Element 7: wherein the degradable plug includes a shell including a channel extending there through, and a degradable core disposed within the channel and formed of a composition that degrades within a predetermined time of exposure to a particular fluid. Element 8: wherein the degradable plug includes a shell including a channel extending there through, a degradable core disposed within the shell and formed of a composition that degrades within the annulus within a predetermined time of first exposure to a particular fluid, and a rupture disk that temporarily protects the degradable core from exposure to the particular fluid, the rupture disk formed of a material that fractures when exposed to a threshold pressure. Element 9: wherein the first wellbore is a main wellbore, and the second wellbore is a lateral wellbore that intersects with the main wellbore. Element 10: wherein the second wellbore is a main wellbore, and the first wellbore is a lateral wellbore that intersects with the main wellbore.

Element 11: inserting an isolation sleeve into the junction such that it contacts the deflector and it deflected into the second leg of the junction, and positioning the isolation sleeve in the second leg of the junction to prevent fluid flow into or out of the first wellbore. Element 12: wherein positioning the isolation sleeve in the second leg of the junction to prevent fluid flow into or out of the first wellbore includes engaging an uphole end of the isolation sleeve with a liner disposed uphole from the intersection of the first wellbore and the second wellbore to form a fluid and pressure tight seal, and engaging a downhole end of the isolation sleeve with the second leg of the junction to form a fluid and pressure tight seal. Element 13: wherein positioning the isolation sleeve in the second leg of the junction to prevent fluid flow into or out of the first wellbore includes engaging an uphole end of the isolation sleeve with a liner disposed uphole from the junction to form a fluid and pressure tight seal, and engaging a downhole end of the isolation sleeve with a sealing sleeve of the deflector extending downhole into the second leg of the junction to form a fluid and pressure tight seal. Element 14: extracting the isolation sleeve to allow fluid flow into or out of the first wellbore. Element 15: removing the degradable plug from the deflector by triggering a chemical reaction that causes the degradable plug to degrade to a point that fluid flow through the channel is permitted.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A wellbore isolation system, comprising:

a junction positioned within a multilateral wellbore at an intersection of a first wellbore and a second wellbore, the junction comprising:

a first leg extending downhole into the first wellbore; and a second leg coupled to the first leg and extending downhole into the second wellbore;

a deflector disposed in the junction such that a path into the first leg of the junction is obstructed and engaged with the first leg of the junction to form a fluid and pressure tight seal, the deflector comprising:

a channel extending axially through the deflector; and a degradable plug disposed in the channel and engaged with the channel to prevent fluid flow through the channel; and an isolation sleeve extending into the second leg of the junction and preventing fluid flow into and out of the first wellbore.

2. The wellbore isolation system of claim 1, wherein an uphole end of the isolation sleeve engages with a liner disposed uphole from the junction to form a fluid and pressure tight seal, and a downhole end of the isolation sleeve engages with the second leg of the junction to form a fluid and pressure tight seal.

3. The wellbore isolation system of claim 1, wherein the degradable plug is formed of a composition that degrades within a predetermined time of exposure to a particular fluid.

4. The wellbore isolation system of claim 1, wherein the degradable plug comprises:

a plug formed of a composition that degrades within a predetermined time of exposure to a particular fluid; and a coating formed around the plug that temporarily protects the plug from exposure to the particular fluid.

5. The wellbore isolation system of claim 1, wherein the degradable plug comprises a first composition imbedded with particles of a second composition to form a galvanic cell.

6. The wellbore isolation system of claim 1, wherein the degradable plug comprises:

a shell including a channel extending there through; and a degradable core disposed within the channel and formed of a composition that degrades within a predetermined time of exposure to a particular fluid.

7. The wellbore isolation system of claim 1, wherein the degradable plug comprises:

a shell including a channel extending there through;

a degradable core disposed within the shell and formed of a composition that degrades within the annulus within a predetermined time of first exposure to a particular fluid; and a rupture disk that temporarily protects the degradable core from exposure to the particular fluid, the rupture disk formed of a material that fractures when exposed to a threshold pressure.

8. The wellbore isolation system of claim 1, wherein:

the first wellbore is a main wellbore; and the second wellbore is a lateral wellbore that intersects with the main wellbore.

9. The wellbore isolation system of claim 1, wherein:

the second wellbore is a main wellbore; and the first wellbore is a lateral wellbore that intersects with the main wellbore.

10. A method of temporarily isolating a wellbore, comprising:

positioning a junction within a multilateral wellbore at an intersection of a first wellbore and a second wellbore, the junction comprising:

a first leg extending downhole into the first wellbore; and a second leg coupled to the first leg and extending downhole into the second wellbore;

positioning a deflector in the junction such that a path into the first leg of the junction is obstructed and the deflector engages the first leg of the junction to form a fluid and pressure tight seal, the deflector comprising:

a channel extending axially through the deflector; and a degradable plug disposed in the channel and engaged with the channel to prevent fluid flow through the channel;

inserting an isolation sleeve into the junction such that the isolation sleeve contacts the deflector and is deflected into the second leg of the junction; and positioning the isolation sleeve in the second leg of the junction to prevent fluid flow into or out of the first wellbore.

11. The method of claim 10, wherein positioning the isolation sleeve in the second leg of the junction to prevent fluid flow into or out of the first wellbore comprises:

engaging an uphole end of the isolation sleeve with a liner disposed uphole from the intersection of the first wellbore and the second wellbore to form a fluid and pressure tight seal; and engaging a downhole end of the isolation sleeve with the second leg of the junction to form a fluid and pressure tight seal.

12. The method of claim 10, wherein positioning the isolation sleeve in the second leg of the junction to prevent fluid flow into or out of the first wellbore comprises:

engaging an uphole end of the isolation sleeve with a liner disposed uphole from the junction to form a fluid and pressure tight seal; and engaging a downhole end of the isolation sleeve with a sealing sleeve of the deflector extending downhole into the second leg of the junction to form a fluid and pressure tight seal.

13. The method of claim 10, further comprising removing the degradable plug from the deflector by triggering a chemical reaction that causes the degradable plug to degrade to a point that fluid flow through the channel is permitted.

14. The method of claim 10, wherein the degradable plug is formed of a composition that degrades within a predetermined time of exposure to a particular fluid.

15. The method of claim 10, wherein the degradable plug comprises:

a plug formed of a composition that degrades within a predetermined time of exposure to a particular fluid; and a coating formed around the plug that temporarily protects the plug from exposure to the particular fluid.

16. The method of claim 10, wherein the degradable plug comprises a first composition imbedded with particles of a second composition to form a galvanic cell.

17. The method of claim 10, wherein the degradable plug comprises:

a shell including a channel extending there through; and a degradable core disposed within the channel and formed of a composition that degrades within a predetermined time of exposure to a particular fluid.

18. The method of claim 10, wherein the degradable plug comprises:

a shell including a channel extending there through;

a degradable core disposed within the shell and formed of a composition that degrades within the annulus within a predetermined time of first exposure to a particular fluid; and a rupture disk that temporarily protects the degradable core from exposure to the particular fluid, the rupture disk formed of a material that fractures when exposed to a threshold pressure.

19. The method of claim 10, wherein:

the first wellbore is a main wellbore; and the second wellbore is a lateral wellbore that intersects with the main wellbore.

20. The method of claim 10, wherein:

the second wellbore is a main wellbore; and the first wellbore is a lateral wellbore that intersects with the main wellbore.

* * * * *